United States Patent [19]

Dobo

[11] 4,023,989

[45] May 17, 1977

[54] METHOD FOR PRODUCING CORDED STEEL WIRE

[75] Inventor: Emerick J. Dobo, Cary, N.C.

[73] Assignee: Monsanto Company, St. Louis, Mo.

[22] Filed: Oct. 20, 1975

[21] Appl. No.: 623,845

[52] U.S. Cl. ..... 148/16; 57/166; 72/274; 75/214; 75/224; 106/165; 140/149; 148/156; 264/178 F

[51] Int. Cl.² ..... C21D 1/48; B21F 7/00; D01D 5/08

[58] Field of Search ..... 148/12.1, 16, 16.5, 148/20.3, 156; 75/.5 R, .5 AA, 20 R, 34, 207, 214, 224; 29/193; 252/513, 519; 72/274; 140/149; 57/140 R, 153; 106/165; 264/165, 195, 176 F, 178 F, 206

[56] References Cited

UNITED STATES PATENTS

| | | | |
|---|---|---|---|
| 2,942,931 | 6/1960 | Mitchell et al. | 106/165 |
| 2,993,018 | 7/1961 | Steinlin | 106/165 |
| 3,406,025 | 10/1968 | Hamling | 75/.5 R |
| 3,565,749 | 2/1971 | Wizon | 106/165 X |
| 3,671,228 | 6/1972 | McIntire et al. | 75/214 |
| 3,748,119 | 7/1973 | Hwang et al. | 75/.5 AA |

*Primary Examiner*—Walter R. Satterfield
*Attorney, Agent, or Firm*—Russell E. Weinkauf

[57] ABSTRACT

A method for making steel wire cord from particulate iron oxides with the aid of a fiber-forming acrylic polymer is disclosed. A plurality of continuous filaments are first formed by wet-spinning an acrylic polymer spin dope in which particles of iron oxide are dispersed. The resulting filaments are drawn to increase their tenacity and then twisted to form a precursor cord. This is followed by exposing the precursor to a reducing atmosphere (e.g., a gaseous mixture of hydrogen and carbon monoxide) at a temperature in the range of from about 900° C. to 1150° C. for a period of about 3 to 8 minutes. Under these conditions, the iron oxide particles are reduced to the metallic state and the polymer in the precursor is pyrolized to carbon and by-product gases. The carbon diffuses into the resulting iron, and the individual metal particles sinter to form continuous steel wire cord having an essentially ferritic/pearlitic structure. When the product is converted to a tempered martensite structure, tensile strengths of at least 280,000 psi are attainable.

9 Claims, 3 Drawing Figures

METHOD FOR PRODUCING CORDED STEEL WIRE

BACKGROUND OF THE INVENTION

This invention is directed to a process for producing twisted steel wire cord in a manner which completely departs from the conventional practice. More particularly, the process involves forming a twisted precursor cord by textile methods and then converting the precursor to steel cord.

Composites of steel and rubber, wherein reinforcing elements of corded steel are bonded to rubber, find wide application in a variety of products which include, for example, conveyor belts, heavy duty hoses, pulley belts and pneumatic tires. The application of such composites in the fabrication of pneumatic tires has become particularly important. That is, there has been an ever increasing use of steel cord to provide the need for a more effective reinforcement of both the belt and carcass in modern vehicular tires.

In the conventional practice, steel tire cord and steel cord for other applications is made by cabling drawn steel wire about a central axis to provide a strand or cord having the desired twist level. This cabling operation generally results in a substantial retention of bending stresses which causes the cord to kink or curl in a helical, spring-like configuration. To reduce the retained stresses, the cord is customarily "killed" either by back twisting, stress relieving, or by mechanical means. However, such treatments are not done without sacrifice of desirable properties. In the case of stress relieving, the cord is heated to relieve the retained stress which causes losses in the tensile property. Mechanical killing, on the other hand, involves plastic deformation of the live strand or cord by sequentially bending the strand or cord over a series or rolls. This treatment typically causes scoring of the steel cord and losses in desirable properties.

Besides the afore-mentioned difficulties, the cost of steel wire produced by the traditional wire drawing procedures is relatively expensive. This becomes apparent when one considers the steps involved merely to obtain the intermediate steel wire rod product. That is, molten steel is cast into ingots which are subsequently rolled into blooms from which billets are formed. Finally, the billet is hot rolled to produce the steel wire rod. The wire rod must then undergo a series of elaborate and costly metal-drawing operations to obtain a steel wire product suitable for use as tire cord or in other applications wherein a relatively fine diameter is required.

It is, therefore, an object of this invention to provide an entirely new and more convenient approach to the production of steel wire cord.

It is a further object of the invention to provide a method for producing corded steel wire which is substantially less costly than the conventional practice.

SUMMARY OF THE INVENTION

In my copending application Ser. No. 624,076 filed on Oct. 20, 1975 and titled, "Method for Making Steel Wire," a procedure is disclosed for making filamentary steel wire from particulate iron oxides with the aid of a fiber-forming acrylic polymer. This is accomplished by employing wet-spinning techniques, such as are commonly used in the textile arts for the production of acrylic fibers. That is, a spinning dope is first made up which contains particles of iron oxide uniformly dispersed in an acrylic polymer solution, and wherein the ratio by weight of iron oxide to acrylic polymer is in the range of from about 3:1 to 7:1. The iron oxide containing acrylic polymer dope is then spun through a spinnerette and directly into a coagulation bath to form precursor filaments. Conversion of the filamentary precursor to steel wire is accomplished by exposing the filaments to a reducing atmosphere (e.g., a gaseous mixture of hydrogen and carbon monoxide) for a period of from about 3 to 8 minutes at a temperature in the range of from about 900° C. to 1150° C. Under these conditions, the iron oxide particles are reduced to the metal state, and the polymer in the precursor is pyrolized to carbon and by-product gases. The carbon is absorbed by the metallic iron, and the individual particles sinter to form continuous steel wire.

The precursor filaments may be drawn or stretched after being formed in the coagulation bath to improve their tensile strength for further handling. In addition, the toughness of the precursor may be improved by a shrinking operation which can be conducted immediately subsequent to the drawing procedure.

It has now been discovered that the precursor filaments obtained in accordance with the above method can be twisted to form cord on standard textile equipment and that the cord so formed is convertible to steel cord in the same manner and under the same conditions as described above for converting precursor filaments to steel wire.

DESCRIPTION OF THE INVENTION

In the context of this invention, the term "acrylic polymer" refers to a fiber forming polymer and includes polyacrylonitrile and copolymers and terpolymers of acrylonitrile. That is, those copolymers and terpolymers are included which are obtained by polymerizing acrylonitrile with monomers such as vinyl acetate, methyl acrylate, vinyl pyridine and others which are known by those skilled in the art to be polymerizable with acrylonitrile to give satisfactory fibers and filaments.

As used herein, the term "iron oxide" is intended to include both hematite ($Fe_2O_3$) and magnetite ($Fe_3O_4$) or mixtures thereof.

For the purposes of this invention, the iron oxide needs to be in particulate form, and in order to achieve the density desired in the ultimate wire product the metal particles should possess a good distribution in particle size. However, the average diameter of the particles should not exceed about 5 microns, with an average diameter of about 1 micron or less being usually preferred.

An excellent source of hematite is the by-product obtained in the regeneration of hydrochloric acid pickling solutions which are used in the iron and steel industry to remove mill scale and other forms of iron oxide from iron and steel products. The procedure includes a reaction chamber which converts the ferrous chloride to ferric oxide and regenerates hydrogen chloride gas. The regenerated hydrogen chloride gas is absorbed in water and the hydrochloric acid obtained is recycled to the pickling bath. The hematite recovered as by-product is in the form of small particles caused by the turbulence of the hot gases in the reaction chamber.

Another source of suitable iron oxides is the high grade iron ore concentrates (more than 95%, by weight, of iron oxide) which are available in various parts of the world. An example is the MAC Maimberget A Concentrate ore from Sweden which contains over 98% by weight of iron oxide (i.e., 96.23% magnetite and 2.24% hematite).

In making up the spin dope from which the precursor filaments are produced, the iron oxide particles are incorporated into a typical acrylic polymer spinning solution in the form of a uniform dispersion. The solvent may be selected from those commonly used in the wet-spinning of acrylic polymers (e.g. dimethylacetamide, dimethylformamide and dimethylsulfoxide) with the ratio by weight of solvent to polymer being in the range of from 3.5:1 to 6:1, and preferably 3.8:1 to 4.5:1, respectively. The iron oxide particles are added in an amount such that the ratio by weight of metal oxide to acrylic polymer is in the range of about 3:1 to 7:1, respectively. Although not required, it is sometimes advantageous to add small amounts of a wetting agent to the dope (e.g., less than 1.0% by weight of sorbitan monopalmitate). Following make-up, the dope components are mixed by well known methods to solubilize the polymer and to obtain a uniform dispersion of the metal oxide.

Filamentary structures are formed from the aforedescribed spin dope by continuously extruding the dope through a desired number of shaped orifices in a spinnerette and directly into a coagulation bath. The pressures required to give satisfactory extrusion rates are nominal and generally do not exceed 50 psig, with the normal range being from about 10 to 50 psig.

As is typical in the wet-spinning of acrylic fibers, the coagulation bath contains both a precipitant and a solvent for the acrylic polymer. The precipitant or coagulant is generally either water or ethylene glycol. And although a wide variety of solvents are applicable, solvents such as dimethylacetamide, dimethylformamide and dimethylsulfoxide often are of preference both in acrylic fiber spinning and in the practice of this invention. For convenience, it is usually desirable to employ the same solvent as was used in preparing the spinning dope.

For the purposes of this invention a binary mixture of water and dimethylacetamide or ethylene glycol and dimethylacetamide is usually preferred. When employing the former the solvent is generally present in the range of from about 30 to 70% by volume, with from 50 to 60% being preferred. When employing ethylene glycol as the coagulant in lieu of water, the dimethylacetamide solvent generally constitutes from about 15 to 85% by volume of the mixture, with from about 40 to 60% being preferred.

With water/dimethylacetamide systems the bath temperatures are those conventionally employed and can range between 28° C. to 70° C., with from about 35° C. to 60° C. being preferred. In the case of ethylene glycol/dimethylacetamide mixtures, the bath temperature may range between 0° C. to 95° C., with from 10° C. to 30° C. being usually preferred. An especially preferred coagulation system is one comprised of a mixture of ethylene glycol and a dimethylacetamide solvent, with the solvent constituting from about 40 to 60% by volume of the mixture. In operation, the coagulating bath containing these components is preferably maintained at a temperature in the range of from about 10° C. to 30° C.

The coagulation step is followed by a polymer orientation step in which the filaments are stretched from about 1 to 3 times their initial length in a conventional hot water or boiling water stretch bath. This orientation and attenuation procedure, which greatly improves filament strength is generally referred to as a "hot cascade" stretch. Stretching is accomplished by correlating the linear entry rate of the filaments into the stretch bath with the rate of withdrawal. When the latter is at a higher rate, stretching of the filament will, of course, occur.

Although optional, further advantages can be realized by following the stretching operation with a shrinking step. This is also accomplished by passing the filaments continuously through a hot or boiling water bath. However, in contrast to the stretching procedure, the filaments are withdrawn from the bath at a speed sufficiently slower than the feed speed to allow relaxation and shrinkage to occur. The extent of shrinkage is usually much less than the stretch originally imparted. In general, the ratio of the length of the filaments before and after shrinking is in the range of from about 1:0.9 to 1:07, respectively. The purpose of this processing step is to improve the toughness of the precursor filaments and to minimize the extent of shrinking which occurs when converting to steel.

The filamentary threadline (consisting of a plurality of continuous filaments) is then forwarded from either the stretching bath or the relaxation bath when used to a twisting device where the filaments are twisted into a precursor cord of the desired design. This can be accomplished by employing standard textile twisting and take-up devices, for example, a cap winder is eminently suitable.

Conversion to steel cord is effected by exposing the precursor cord to a reducing atmosphere at a temperature in the range of from about 900° C. to 1150° C. over a time span of from about 3 to 8 minutes. Under these conditions, the iron oxide particles are reduced to iron, and the acrylic polymer in the precursor is converted to carbon and by-product gases. The carbon diffused into the metallic iron, and the individual metal particles sinter to form continuous steel wire cord.

It has been found that good results are achieved when the reducing atmosphere is comprised of a gaseous mixture consisting of from about 80 to 98% by volume of hydrogen, from 2 to 15% by volume of carbon monoxide and from 0 to 10% by volume of a carburizing gas. In addition to contributing to the reduction of iron oxide to iron, the carbon monoxide serves to control the diffusion of carbon into iron. An especially efficient reduction is realized when the hydrogen component of the reducing atmosphere contains a mixture of both atomic and molecular hydrogen. That is, atomic hydrogen will diffuse more readily into the interstices of the metal oxides than will molecular hydrogen because of its smaller size and weight. This faster diffusion rate will, of course, facilitate reduction. In addition, the presence of atomic hydrogen increases the inherent reduction power of the system. A carburizing medium may be included in the reducing gas mixture, if desired, to provide an additional source of carbon to further enhance the tensile strength of the ultimate steel wire cord product. When used, the carburizing gas may be selected from the hydrocarbon gases commonly used in the steel industry as a carburizing medium to supply a quantity of carbon for absorption and diffusion into steel. Included among such gases are methane, ethane, propane and butane, with methane and propane being especially preferred.

In a preferred mode for carrying out the conversion step of the process, the precursor cords are continuously processed through and elongated furnace which has been heated to an appropriate temperature. The reducing gas mixture is caused to flow within the furnace in a reverse direction to the direction of movement of the precursor cord. In this manner the steel wire cord being formed never "sees" an oxidizing environment until the process is complete and the product exits the furnace to a take-up device.

In addition to effecting a reduction, the reducing gases cool the moving wire cord at the point of contact therewith to produce a ferrite/pearlite structure with the pearlite having a relatively fine grain structure. The tensile properties may be improved by conversion to a tempered martensite. This can be accomplished by well-known methods which involves heating the product to the austenitic temperature, quenching and then tempering.

Attention is now directed to the attached drawing in which apparatus for carrying out the method of this invention is illustrated.

Figure 1:
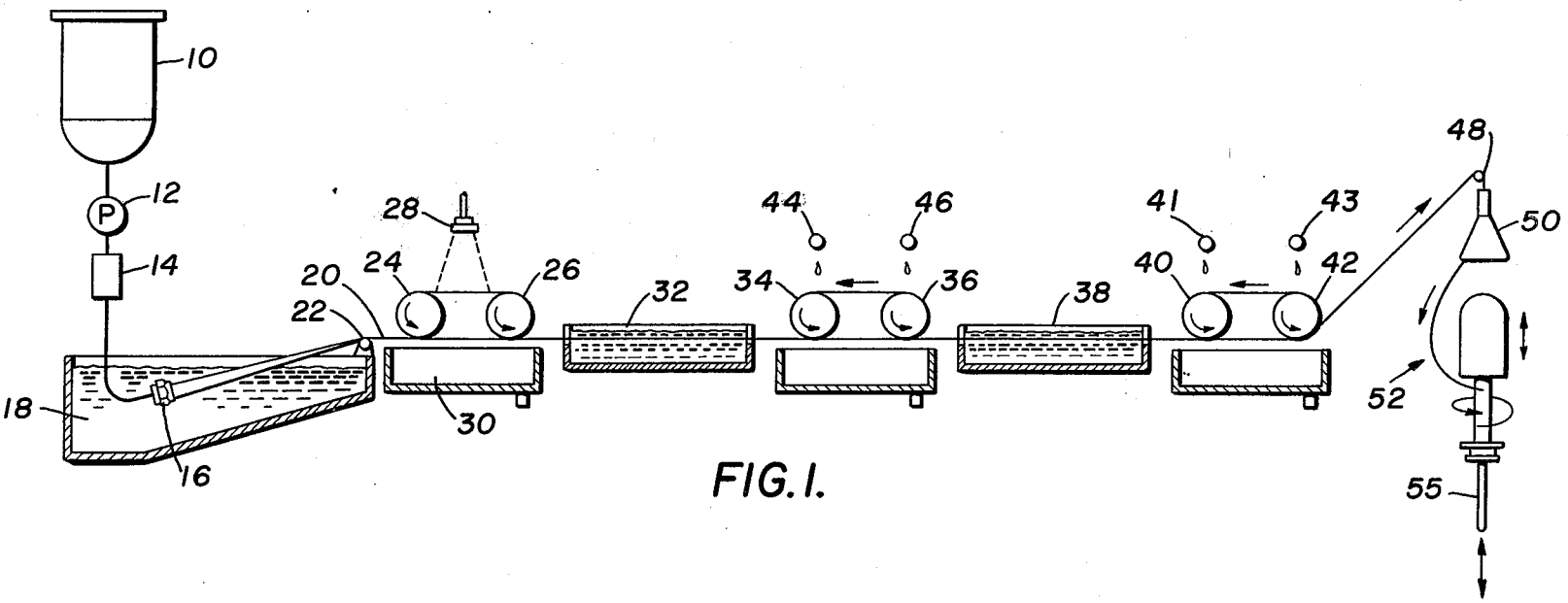
FIG. 1 is a side elevational view partly in section of a filament spinning line having a cap twister as a take-up device.

Referring now to FIG. 1, a spin dope consisting of an acrylic polymer solution with iron oxide particles uniformly dispersed therein is pumped from supply tank 10 by pumping means 12 through filter 14 and thence to spinnerette assembly 16. The dope is extruded through the filament shaping orifices of the spinnerette and passes directly into coagulation bath 18 where a plurality of continuous filaments are formed. From the coagulation bath the filaments are withdrawn over guide means 22 by positively driven filament advancing rolls 24 and 26. When on these rolls, the filaments are water washed to complete the coagulation and to remove residual solvent. The water is supplied from a spray or shower head 28, with the wash water being collected in a container or tray 30. It will be recognized that the washing operation can be conducted in more than one stage of the process and by the employment of other known washing means. After leaving rollers 24 and 26, the filaments are directed into a "hot cascade" bath 32 which contains hot or boiling water. The filaments are withdrawn therefrom by means of driven rollers 34 and 36, which are operated at a peripheral speed greater than that of rolls 24 and 26 so that the filaments are caused to stretch during passage through hot water bath 32. After leaving rollers 34 and 36, the filaments are directed into a second hot or boiling water bath 38. They are withdrawn from bath 38 by means of rolls 40 and 42 which are driven at a peripheral speed less than that of rolls 34 and 36 so that the filaments are permitted to relax and thereby shrink during passage through the bath. In order to keep the filaments moist and thereby facilitate processing, water is dripped on rolls 34 and 36 through pipes 44 and 46. Likewise water is dripped onto rolls 40 and 42 through pipes 41 and 43. From rolls 40 and 42 the filamentary thread line is forwarded to cap twister 52 where the filaments are twisted into cord and taken up. A uniform lay-down on the rotating spindle of the cap twister is effected by reciprocating rod 55 which causes the cap to reciprocate along the spindle in like manner.

Figure 2:
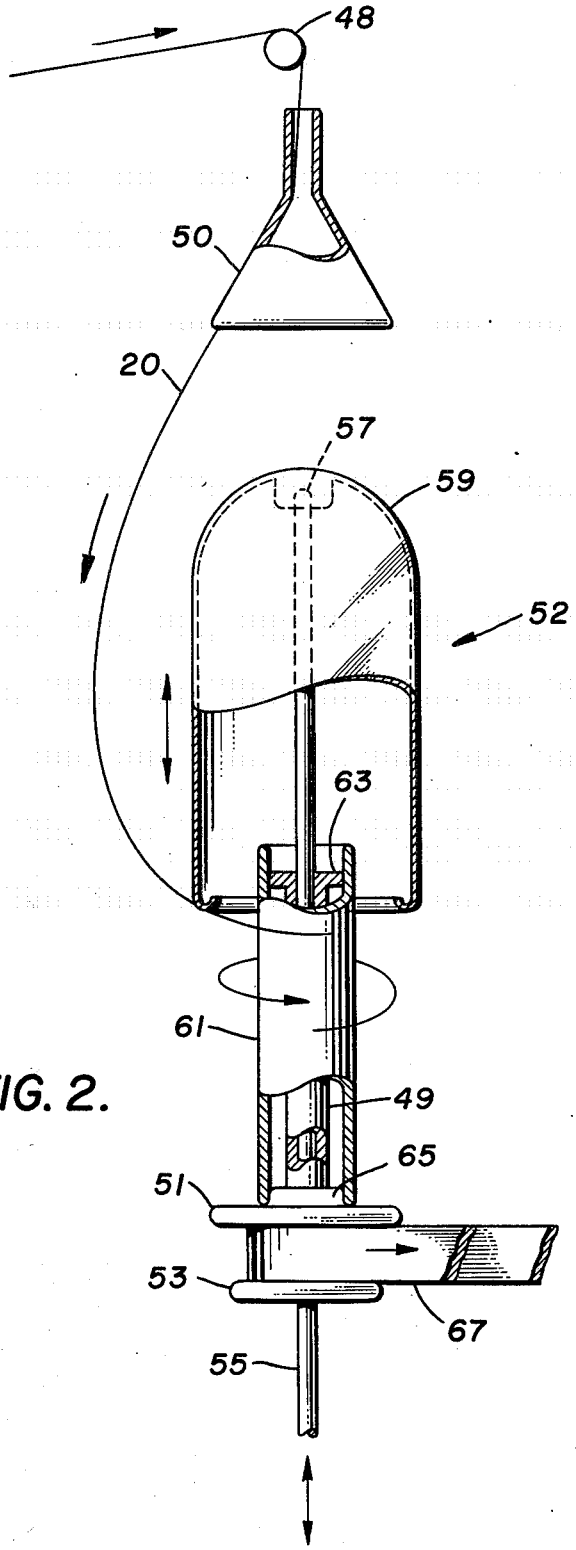
FIG. 2 shows a side elevational view partly in section of a cap twister device which may be used to twist the precursor filaments into cord.

Referring now to FIG. 2 wherein the cap twister of FIG. 1 is illustrated in greater detail. As shown, thread line 20 is delivered over guide 48 and through conical guide 50 from where it passes under the lip of hollow cap 59 and thence onto rotating bobbin 61. Bobbin 61 is placed on spindle 49 and secured thereto by flange members 63 and 65. The spindle 49 is caused to rotate by a driven pulley belt 67 positioned between flange members 51 and 53 with the rotary motion being transmitted to the attached bobbin 61. Rod 55 having one end thereof secured in fitting 57 inside cap 59 is caused to reciprocate by the action of a cam or other means (not shown). This is turn causes cap 59 to reciprocate through the length of bobbin 61 which effects a uniform winding of the twisted thread line about the length of the bobbin. The rapid rotation of the thread line 20 causes it to "balloon out" as is shown. This rapid rotation causes a tension to develop and pulls the thread line into a position so that rotation of bobbin 61 causes thread line 20 to twist. Actually, both the winding and the twisting are accomplished simultaneously once the operation is underway.

Figure 3:
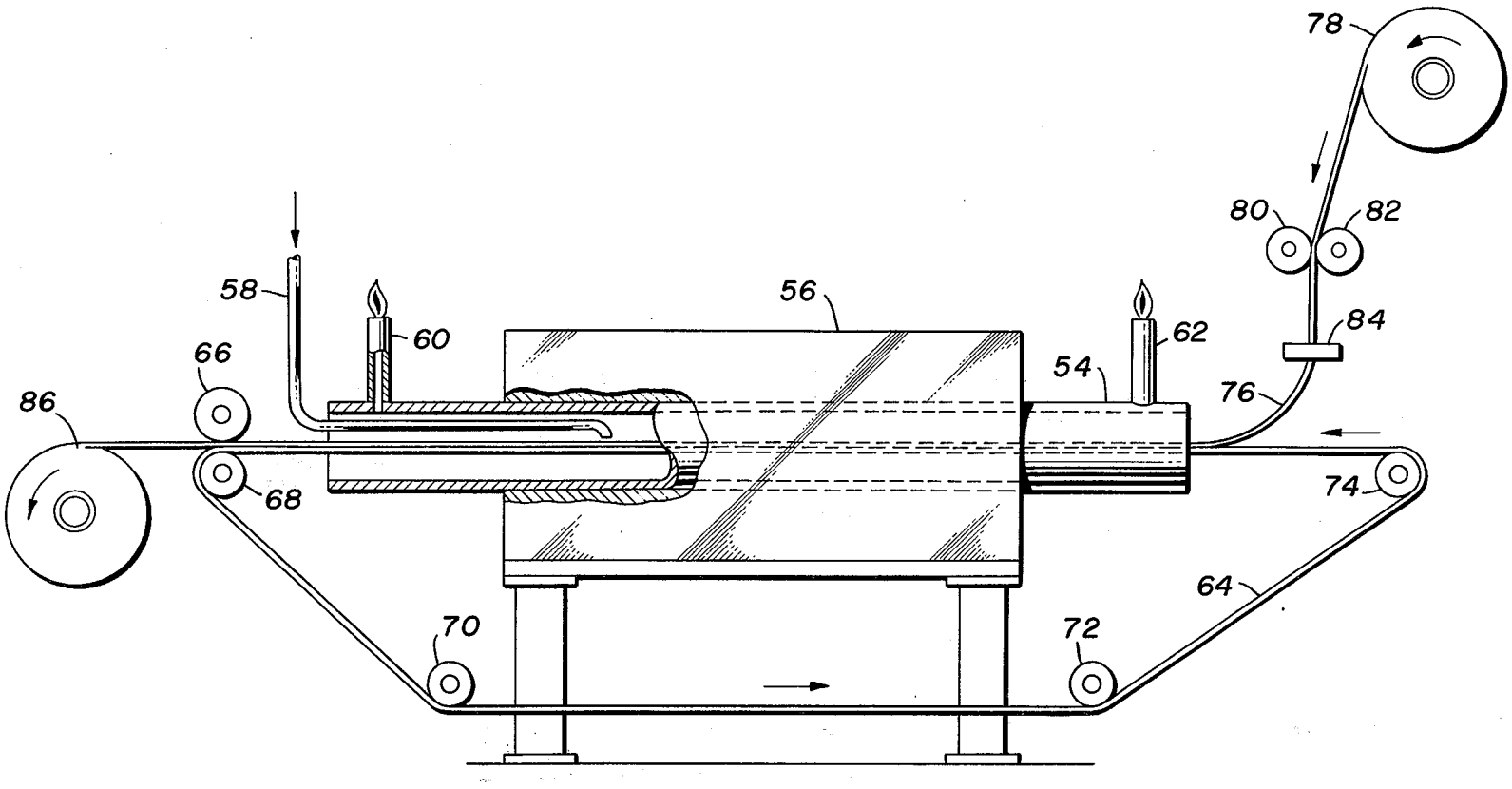
FIG. 3 is a schematic side elevational view partly in section illustrating a furnace arrangement suitable for use in converting the precursor cord to steel wire cord.

A type apparatus which may be employed for converting the twisted precursor cord to steel wire cord is illustrated in FIG. 3. An elongated heating chamber 54 is shown having its mid-section encased in an insulated housing member 56 in which resistance heating elements (not shown) are embedded. A gas inlet tube 58 for introducing reducing gases is inserted into one end of the elongated heating chamber 54 and flare tubes 60 and 62 for gas burn-off are provided at each of the opposing ends of the chamber. An endless steel belt 64, is provided for carrying the filaments being processed through heating chamber 54. The endless belt is propelled by a series of driven rolls 68, 70, 72, and 74.

In operation, precursor filaments 76 supplied from feed roll 78 are laid on the endless belt 64 after first passing through the nip of tension rolls 80 and 82 followed by passage through speed sensor 84. The speed sensor is a photoelectric relay used to coordinate the feed rate of the filament thread line with the belt movement. The endless belt carries the filaments through heating chamber 54 in a direction opposite to the flow of gas entering the system from gas inlet tube 58. Upon exiting the heating chamber the steel wire obtained passes through the nip of spring loaded tension rolls 66 and 68 and onto a take-up device 86.

As a further aid to an understanding of the invention, the following example of an actual run is presented.

EXAMPLE

One thousand grams of hematite ($Fe_2O_3$) and 212.1 grams of a copolymer consisting of 93 percent by weight of acrylonitrile and 7 percent by weight of vinyl acetate were intimately mixed in a rod mill for 10 hours. Thereafter, a solvent mix consisting of 850 cc of dimethylacetamide, 0.5 cc ethylene glycol and 1.2 cc of sorbitan monopalmitate was chilled to 10° C. and placed into a large Waring blender. The mixture of iron oxide and polymer was then also transferred to the blender and stirred in by hand to give a fairly uniform mixture. The solvent was pre-chilled to reduce its solvency so that the polymer could be dispersed mechanically with limited amounts going into solution. The Waring blender was then brought to high speed and further blending of the oxide and complete solution of the polymer took place. The blender was turned off when a final temperature of 42.5° C. was attained as sensed by a thermocouple in the mixture. The heat for the temperature rise resulted from the degradation of mechanical energy supplied by the blending device. During the mixing period, a vacuum of 22 inches of mercury was pulled on the contents of the blender to reduce the amount of air entrapment in the mixture.

The contents of the blender were transferred to the dope pot of a wet spinning line where the precursor dope was subjected to a vacuum of 22 inches of mercury for one-half hour and then pressurized to 35 psi. for one-quarter of an hour. This step was undertaken to again reduce entrained air that could cause voids in the precursor fiber. A positive displacement pump delivered 15.6 cc per minute of the dope through a cup spinnerette which had five holes each of 20 mils in diameter. Upon emerging from the spinnerette, the dope thread lines entered a coagulation bath which was at a temperature of 24° C. The coagulation system employed consisted of a mixture of 50.2% by volume of ethylene glycol and 49.8% by volume of dimethylacetamide. An acrylic plasticizer (N,N-dimethyl lauramide) was also present in the bath in an amount of 0.1 percent by weight of the coagulating mixture. The thread line was taken up at the first godet (thread advancing rolls) at 20 feet per minute and washed with the bath solution to continue the gentle coagulation process. The second godet received the thread line at the rate of 20 feet per minute. Here the thread line was washed with water to complete the coagulation. Then the thread line was stretched in boiling water to orient the filaments. This step occurred between the second and the third godet which rotated at a rate of 50 feet per minute. Relaxation and a consequent shinking of the filaments occurred in boiling water between the third and fourth godet which rotated at the rate of 40 feet per minute. On leaving the fourth godet, the filamentary thread line was taken up on a standard cap twister with the spindle rotating at 720 revolutions per minute to provide 1.5 twists per inch in the thread line.

The take-up bobbin from the filament spinning line was place in the feed position of a furnace conversion system, and a thread line was fed into the furnace at a rate of approximately 11 inches per minute on a belt moving at the rate of 4.0 inches per minute. The dwell time in the furnace was about 6 minutes at a temperature of 1100° C. The difference in the rates of movement between the belt and the precursor feed is accounted for by the shrinkage of the thread line which occurs during the conversion operation. To coordinate the feed rate of the thread line with the belt movement, the thread line position before entering the furnace was sensed by a photoelectric relay. A reducing gas mixture consisting of 92.3% by volume of hydrogen, 4.4% by volume of methane and 3.3% by volume of carbon monoxide was introduced into the furnace near the end opposite to that of the feed entry.

The steel cord product obtained was of an essentially pearlitic-ferritic structure having a carbon content of 0.7% by weight. In spite of the closeness of the individual filaments due to the twist imparted, the cord product showed no married strands.

To convert into a tempered martensite, the steel wire cord was heated continuously in a furnace to 831° C. and then quenched in oil at 102° C. to give a martensitic structure. Post-tempering at 300° C. in oil for 5 minutes gave a tempered-martensitic structure having a tensile strength of 280,000 psi and an elongation of 2.1%.

Although the invention has been described with particular reference to steel wire cord, the method is also fully applicable to the production of corded wire comprised of an alloy of steel. This is readily accomplished by merely combining one or more other metal oxides with iron oxide when making up the spin dope used to form the precursor filaments. Such spin dope will then contain a mixture of metal oxide particles dispersed in an acrylic polymer solution, with the particles having an average diameter of 5 microns or less. The weight ratio of combined metal oxide to acrylic polymer should be in the range of from about 3:1 to 7:1. Any metal oxide may be used in combination with iron oxide so long as the range of conditions by which it may be reduced and sintered overlap with those of iron oxide. Among others, nickel oxide and cobalt oxide are examples of compounds which may be suitably combined with iron oxide to produce alloyed steel cord. The proportions of the various metal oxides can be widely varied according to the properties desired in the ultimate product.

Although the invention has been described with respect to details of the preferred embodiments, many modifications and variations which clearly fall within the scope of the invention as defined by the following claims will become apparent to those skilled in the art.

I claim:

1. A method for producing steel wire cord from particles of iron oxide with the aid of a fiber-forming acrylic polymer, said method comprising the following steps in sequence:

a. providing a spinning dope wherein particles of iron oxide having an average diameter of about 5 microns or less are uniformly dispersed in a solution of acrylic polymer with the weight ratio of iron oxide to acrylic polymer being within the range of from about 3:1 to 7:1, respectively;

b. forming a plurality of continuous filaments by extruding said dope through a spinnerette and into a coagulation bath;

c. stretching said filaments from about one to three times their initial length in a boiling water bath;

d. twisting said filaments to form a precursor cord; and e. converting said precursor cord to steel wire cord by exposing said precursor to a gaseous atmosphere consisting of from about 80 to 94 percent by volume of hydrogen, from about 2 to 15 percent by volume carbon monoxide, and from 0 to 10 percent by volume of a gaseous hydrocarbon at a temperature in the range of from about 900° C. to 1150° C. for a period of from about 3 to 8 minutes.

2. The method in accordance with claim 1, wherein said iron oxide is selected from the group consisting of hematite magnetite or mixtures of hematite and magnetite.

3. The method in accordance with claim 1, wherein said acrylic polymer is a copolymer consisting of 93 percent by weight of acrylonitrile and 7 percent by weight of vinyl acetate.

4. The method in accordance with claim 1, wherein the solvent in said solution of acrylic polymer is dimethylacetamide.

5. The method in accordance with claim 1, wherein said coagulation bath consists essentially of 40 to 60 percent by volume of ethylene glycol and 40 to 60 percent by volume of dimethylacetamide.

6. The method in accordance with claim 1, wherein the hydrogen in said reducing atmosphere is a mixture of molecular and atomic hydrogen.

7. A method for producing steel wire cord from particles of iron oxide with the aid of a fiber-forming acrylic polymer, said method comprising the following steps in sequence:

a. providing a spinning dope wherein particles of iron oxide having an average diameter of about 5 microns or less are uniformly dispersed in a solution of acrylic polymer with the weight ratio of iron oxide to acrylic polymer being within the range of from about 3:1 to 7:1, respectively;

b. forming a plurality of continuous filaments by extruding said dope through a spinnerette and into a coagulation bath;

c. stretching said filaments from about one to three times their initial length in a boiling water bath;

d. shrinking said filaments in a boiling water bath such that the ratio of their length before and after shrinking is in the range of from 1:0.9 to 1:0.7, respectively.

e. twisting said filaments to form a precursor cord;

f. converting said precursor cord to steel wire cord of an essentially ferritic-pearlitic structure by exposing said precursor to a gaseous atmosphere consisting of from 80 to 94 percent by volume of hydrogen, from about 0 to 10 percent by volume of methane and from about 2 to 5 percent by volume of carbon monoxide at a temperature in the range of from about 900° C. to 1150° C. for a period of from about 3 to 8 minutes; and g. converting said steel wire cord to a tempered martensite structure.

8. A method for producing steel alloy wire cord derived from a mixture of metal oxide particles consisting of iron oxide and one or more other metal oxides capable of being reduced and sintered at conditions effective for accomplishing a reduction and sintering of iron oxide, said method comprising the following steps in sequence:

a. providing a spinning dope wherein said mixture of metal oxide particles having an average diameter of about 5 microns or less are uniformly dispersed within a solution of acrylic polymer with the weight ratio of iron oxide to acrylic polymer being within the range of from about 3:1 to 7:1, respectively;

b. forming a plurality of filaments by extruding said dope through a spinnerette and into a coagulation bath;

c. stretching said filaments from about one to three times their initial length in a boiling water bath;

d. twisting said filaments to form a precursor cord; and e. converting said precursor cord to steel alloy wire cord by exposing said precursor to a gaseous atmosphere consisting of from about 80 to 94 percent by volume of hydrogen, from about 2 to 15 percent by volume of carbon monoxide, and from 0 to 10 percent by volume of a gaseous hydrocarbon at a temperature in the range of from about 900° C. to 1150° C. for a period of from about 3 to 8 minutes.

9. A precursor cord obtained in accordance with claim 1, and wherein said precursor cord is convertible to steel wire cord in accordance with the procedure at set forth in claim 1.

* * * * *